United States Patent [19]

Tominari

[11] Patent Number: 4,955,057

[45] Date of Patent: Sep. 4, 1990

[54] REVERB GENERATOR

[75] Inventor: Noboru Tominari, Tokyo, Japan

[73] Assignee: Dynavector, Inc., Tokyo, Japan

[21] Appl. No.: 152,280

[22] Filed: Feb. 4, 1988

[30] Foreign Application Priority Data

Mar. 4, 1987 [JP] Japan ..... 62-49472
Apr. 13, 1987 [JP] Japan ..... 62-88644

[51] Int. Cl.[5] ..... G10H 1/04
[52] U.S. Cl. ..... 381/63
[58] Field of Search ..... 381/63, 61, 17, 18

[56] References Cited

U.S. PATENT DOCUMENTS

| | | | |
|---|---|---|---|
| 3,670,104 | 1/1972 | Orban | 381/17 |
| 3,992,582 | 11/1976 | Osakabe . | |
| 4,097,689 | 6/1978 | Yamada et al. . | |
| 4,215,242 | 7/1980 | Gross | 381/63 |
| 4,472,993 | 9/1984 | Futamase | 381/63 |
| 4,566,119 | 1/1986 | Peters | 381/103 |
| 4,594,729 | 6/1986 | Weingartner | 381/86 |
| 4,603,429 | 7/1986 | Carver | 381/18 |
| 4,653,096 | 3/1987 | Yokoyama | 381/63 |
| 4,694,497 | 9/1987 | Kasai | 381/63 |
| 4,706,287 | 11/1987 | Blackmer | 381/63 |

FOREIGN PATENT DOCUMENTS

| | | |
|---|---|---|
| 3619031 | 6/1986 | Fed. Rep. of Germany . |
| 3806915 | 3/1988 | Fed. Rep. of Germany . |
| 47797 | 4/1980 | Japan . |
| 281799 | 12/1986 | Japan . |
| 2177576 | 1/1987 | United Kingdom . |

OTHER PUBLICATIONS

Tonstudiotechnik, by Johannes Webers, Munich, Sep. 20, 1979, p. 82.
Digital Filtering, by Chamberlin, Musical Applications of Microprocessors, 1980, pp. 447–451.
Kunstilicher Nachhall, by Von H. Kuttruff, Frequenz, Bd. 1982, Nr. 3, pp. 91–96.
M. R. Schroeder, Journal of the Audio Engineering Society, Jul. 10, 162, vol. 10, No. 3.

*Primary Examiner*—Tommy P. Chin
*Attorney, Agent, or Firm*—Pennie & Edmonds

[57] ABSTRACT

A reverb generator comprises a delay circuit for delaying an input audio signal, a feed back path connecting an output port of the delay circuit to its input port, and a phase shifter connected in series to the delay circuit. The phase shifter produces a dispersion in the spectrum of the input audio signal in accordance with frequency dependent delay characteristic in such a manner that the delay time is large in a low frequency range and small in a higher frequency range. By including the phase shifter in the feed back path, one can obtain an output audio signal having a spectrum which is repeatedly subjected to dispersion, thus simulating the effect of dispersion due to the multiple reflections taking place in an actual concert hall.

8 Claims, 8 Drawing Sheets

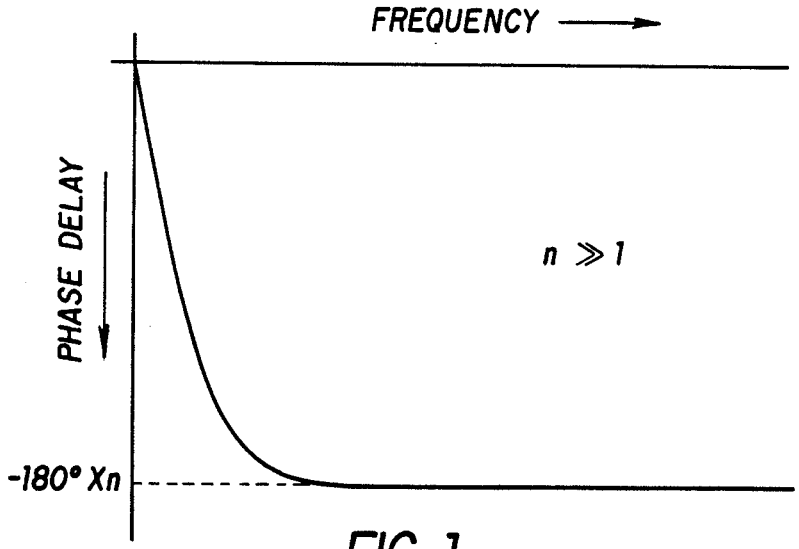
FIG. 1 PRIOR ART
FIG. 5(a)
PRIOR ART
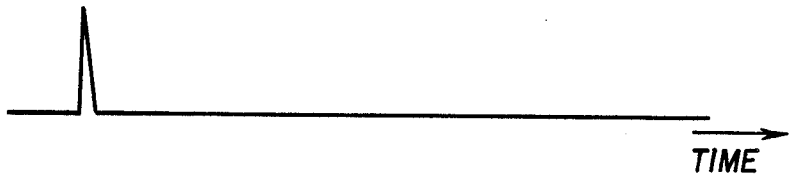
FIG. 5(b)
PRIOR ART
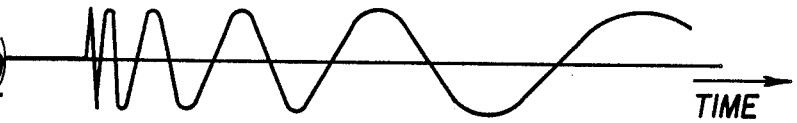

a1
a2
a3
a4
a5

ΔT
ΔT
ΔT
ΔT
ΔT
TIME

TIME

TIME

TIME

TIME

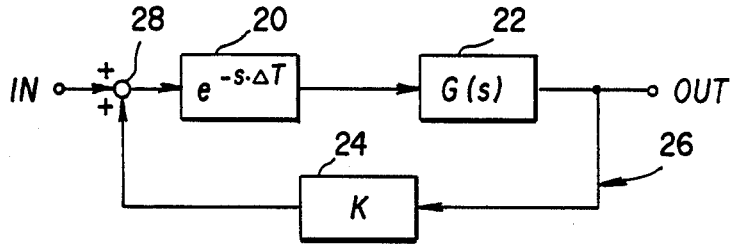
FIG. 10
FIG. 11(a)
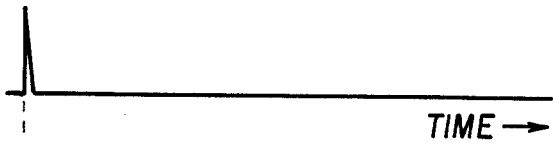
FIG. 11(b) $e^{-s\cdot\Delta T}\,G(s)$
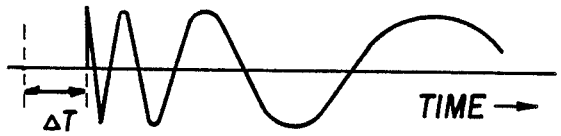
FIG. 11(c) $Ke^{-2s\cdot\Delta T}G(s)^2$
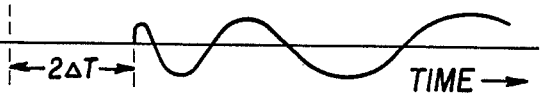
FIG. 11(d) $K^2e^{-3s\cdot\Delta T}\,G(s)^3$
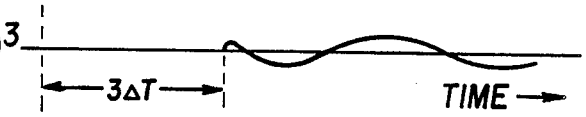

REVERB GENERATOR

BACKGROUND OF THE INVENTION

The present invention generally relates to reverb generators and more particularly to a reverb generator including a phase shifter or so called all-pass filter for applying a dispersion to an input audio signal spectrum.

Reverb generators are used in electric acoustic systems such as an electric musical instrument or a sound reproducing system for providing reverberations to the reproduced sound, or for enhancing the presence such that a listener feels as if he or she is listening to the reproduced sound in a concert hall or the like.

Conventional reverb generators typically comprise a delay circuit for delaying an input audio signal irrespective of the frequency and a feed back path including an attenuator for feeding back an output signal of the delay circuit to an input side thereof with a predetermined attenuation In the past, reverb generators used a tape recorder or a mechanical resonator as a delay means. In recent years, digital circuits are commonly used for this purpose.

A typical reverb generator produces a series of exponentially attenuating output impulses repeatedly responsive to a single input impulse with a predetermined interval of $\Delta T$ which is specified by the delay time of the delay circuit. The attenuation of the output impulses is determined by the attenuating constant of the attenuator which controls the feed back ratio of the feed back path.

Such a conventional reverb generator has only two variable parameters for adjusting the reverberation, i.e. the attenuating constant of the attenuator and the delay time of the delay circuit Thus, there is a problem that the degree of freedom in the sound processing is limited. Further, there is a more serious problem in such a conventional reverb generator that an unnatural reverberation is generated when the feed back ratio and/or the delay time is increased in order to achieve a long sustaining reverberation or an enhanced presence as is realized in the actual concert hall. In an extreme case, the individual reverberations can be resolved by human ears and the individual reverberations cause an unpleasant feeling to the listener. Unless such an extraordinary effect is intentionally sought for, the range in which the attenuation constant and the delay time can be varied is extremely limited. As a result of this limitation, the achieved acoustic effect such as the presence of the natural and pleasant reverberation is correspondingly limited.

For example, if the delay time $\Delta T$ exceeds about 30 msec, unnatural feeling becomes too conspicuous for actual use. Long sustaining reverberations caused by increasing the feed back rate similarly induce an unpleasant and unnatural acoustic effect. Thus, in the conventional feedback type reverb generator having an open loop transfer function of $K.e^{-s.\Delta T}$, the value of K specifying the feed back rate can not be chosen practically larger than 0.2–0.4. If one increases the value of K, the duration the reverb sustains is certainly extended but the undesirable effect such as the unnatural and unpleasant feeling or the distortion of the reverberation becomes conspicuous. In other words, the conventional reverb generator cannot fully exploit the advantageous feature of the feed back path which is potentially capable of developing a series of extremely long lasting and gradually changing reverberations repeatedly one after another by feeding back the generated reverberations.

Commonly owned U.S. patent application Ser. No. 111,075, a continuation of Ser. No. 867,234 filed on May 23, 1986 by Tominari, discloses simulation of a reverberation or so-called indirect sound in a concert hall by using an all-pass filter having a constant gain throughout the entire frequency range. The all-pass filter induces a frequency dependent time delay in such a manner that the time delay is large in a low frequency range and small in higher frequency range. In other words, the all-pass filter disclosed in the above U.S. patent application provides an electrical means for simulating the dispersion of the spectrum of the sound which takes place when the sound from a sound source is reflected by walls or floor of the concert hall. The conventional reverb generator lacks this capability of dispersion, and it is believed that this is the reason why the conventional reverb generators fail to produce the natural and pleasant long sustaining reverberations. It is known that a listener in the concert hall feels the presence as a result of the difference between the arrival time of a direct sound reaching the listener directly from the sound source and the indirect sound or reverberation caused by the reflections of the sound at the walls or floor of the concert hall. This indirect sound of course has a spectrum which is dispersed as already described.

In an actual concert hall, the sound wave radiated from the sound source is reflected repeatedly by the walls or the floor Thus, the indirect sound usually includes sound components produced by a plurality of reflections. Such a multiple reflection provides a feeling of dimension of the concert hall and is desirable for achieving the natural presence in the reproduced sound. The system and method described in the aforementioned U.S. patent application, though capable of producing a natural reverberation, cannot simulate the effect of such multiple or repeated reflections.

SUMMARY OF THE INVENTION

Accordingly, it is a general object of the present invention to provide a novel and useful reverb generator for generating a reverberation while applying a dispersion to the spectrum of an input audio signal, whereby the problems aforementioned are eliminated.

Another and more specific object of the present invention is to provide a reverb generator for generating, responsive to an input audio signal, a plurality of reverberations each having signal spectrum involving a dispersion, comprising a delay circuit having a feed back path for repeatedly producing attenuated output audio signals respectively being delayed by a delay time of $\Delta T$, and an all-pass filter connected in series to said delay circuit for applying the dispersion to the spectrum of the input audio signal passing through the delay circuit, said all-pass filter causing the dispersion to vary with respect to the spectrum of an input signal supplied thereto in accordance with a frequency versus phase delay characteristic, such that the phase delay increases steeply with frequency in a low frequency range and gradually approaches a very large constant preferably larger than about 3000 degrees in a higher frequency range.

Still another object of the present invention is to provide a reverb generator in which a feed back path is provided between an output port and input port of a delay circuit for delaying an input audio signal by a delay time of $\Delta T$, said feed back path including an attenuator for controlling a feed back ratio of the feed back path and an all-pass filter connected in series to said delay circuit for causing dispersion to the spectrum of an input signal supplied thereto in accordance with a frequency versus phase delay characteristic such that the phase delay increases steeply with frequency in a low frequency range and gradually approaches a very large constant preferably larger than about 3000 degrees in a higher frequency range.

According to the reverb generator of the present invention, the degree of freedom in adjusting the reverberation increases as the reverb generator includes the frequency versus phase delay characteristic as one of the adjustable parameters in addition to the usual feedback rate and the delay time, a natural and pleasant reverberation is obtained as a result of the use of the all-pass filter, the reverberation remains natural and pleasant even if the feed back rate or the delay time is increased, the effect of the multiple reflections taking place in a concert hall can be simulated by using the feed back path, and a long sustaining pleasant reverberation is obtained as a result of the combination of the all-pass filter and the feed back path.

According to another aspect of the present invention, the input audio signal spectrum is repeatedly dispersed one after another as a result of the all-pass filter being included in the feedback path, so that an extremely colorful reverberation can be produced by selecting a large feed back rate. The reverberation thus produced is very close to the actual reverberation produced in the concert hall as the reverberation in the actual concert hall is dispersed repeatedly by being reflected by the walls or floor of the concert hall a plurality of times.

According to still another aspect of the present invention, a listener can feel the dimension of the concert hall by adjusting the delay time $\Delta T$. Of course, it is possible to obtain an extraordinary effect in which each of the plurality of the reverberations is resolved by human ears, by intentionally suppressing the dispersion and increasing the feed back rate and the delay time $\Delta T$ at the same time.

Further, an unexpected effect was found in which when applying the reverb generator of the present invention to a multi-channel reproducing system as disclosed in the aforementioned U.S. patent application Nos. 867,234 and 111,075, the direction of a sub-speaker radiating the indirect sound (reverberation) relative to the direction of a main speaker radiating the direct sound can be chosen as large as 90 degrees without deteriorating the presence. This is a significant improvement compared to the conventional case in which the angle between the main and sub-speakers is limited within about 30 degrees.

The foregoing and other features and advantages of the present invention will become more apparent in the light of the following detailed description of preferred embodiments thereof as illustrated in the accompanying drawings.

BRIEF DESCRIPTION OF THE DRAWINGS

FIG. 1 is a graph showing a frequency versus phase delay characteristic of an all-pass filter used in the reverb generator according to the present invention;

FIGS. 5(A) and (B) are diagrams showing an impulse response of the all-pass filter having the frequency versus phase delay characteristic and the corresponding frequency versus delay time characteristic respectively shown in FIGS. 1 and 2;

FIG. 10 is a circuit block diagram showing a second embodiment of the reverb generator according to the present invention;

FIGS. 11 (A)–(D) are diagrams showing an impulse response of the reverb generator as shown in FIG. 9;

DETAILED DESCRIPTION

Figure 2:
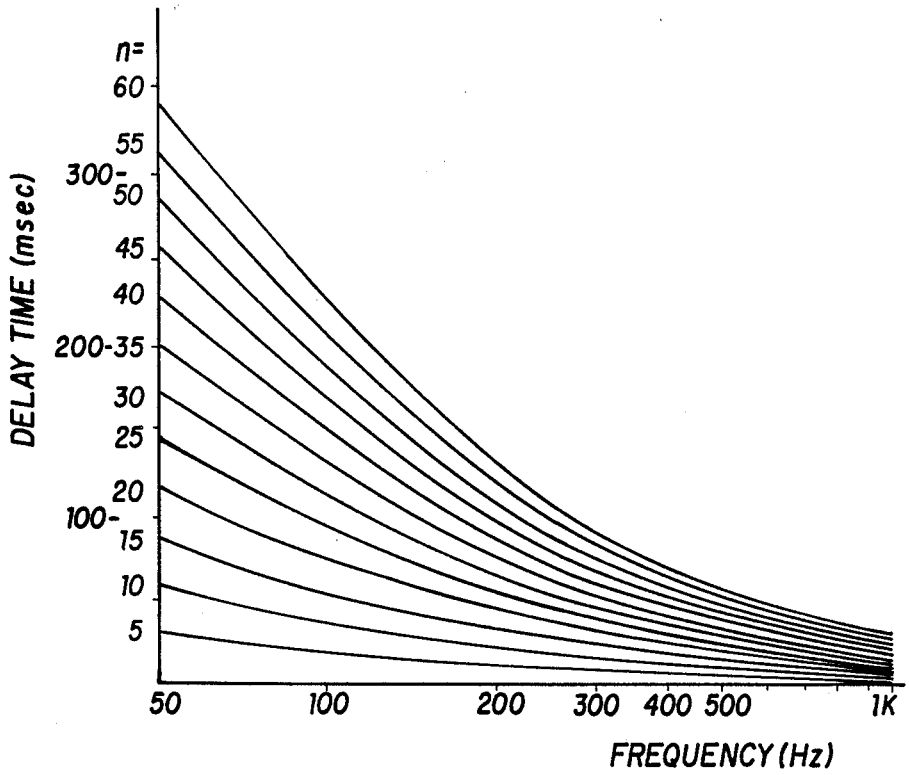
FIG. 2 PRIOR ART
FIG. 2 is a graph showing a frequency versus delay time characteristic corresponding to the frequency versus phase delay characteristic in FIG. 1.

FIG. 1 shows a frequency versus phase delay characteristic of an all-pass filter having a constant gain irrespective of the frequency for use in the reverb generator of present invention. Such an all-pass filter is described in commonly owned U.S. patent application Nos. 867,234 and 111,075. The all-pass filter shown in the drawing has a transfer function represented by the following equation:

$$G(s) = \prod_{i=1}^{n} \frac{1 - \tau_i \cdot s}{1 + \tau_i \cdot s} \tag{1}$$

where s designates a complex frequency commonly know as the Laptacian, $\tau_i$ is a time constant and n is a positive integer.

Thus, the all-pass filter produces a phase delay which increases steeply in a low frequency range and gradually approaches a very large constant phase angle which is a multiple of pi radians or $n \times 180°$ degrees in a higher frequency range. It is convenient to choose the time constant $\tau_i$ to have a common time constant $\tau$. In this case, Eq.(1) is simplified as follows:

$$G(s) = \left( \frac{1 - \tau \cdot s}{1 + \tau \cdot s} \right)^n \tag{2}$$

It is easy to prove that the all-pass filter having the transfer function of Eq.(1) or (2) has a unity gain throughout the entire spectrum range and the angle of phase delay approaches $n \times 180$ degrees when the frequency is infinite.

The delay time produced by the all-pass filter at each frequency f is proportional to a derivative of the phase delay, $-d\phi/df$. Thus, corresponding to the frequency versus phase delay characteristic of FIG. 1, a frequency versus delay time characteristic as shown in FIG. 2 is obtained in which the delay time is small in the higher frequency range and increases steeply with the decrease of the frequency in the low frequency range. In FIG. 2, a series of curves representing the frequency versus delay time characteristic is shown together with the positive integer n in Eqs (1) or (2) as a parameter.

FIG. 5 shows a typical example of the impulse response of the all-pass filter having the frequency versus phase delay characteristic and the corresponding frequency versus delay time characteristic respectively shown in FIGS. 1 and 2. As can be seen in the drawing, a higher frequency component appears immediately after an input impulse while lower frequency components appear in later. This is a phenomenon called "dispersion".

Figure 3:
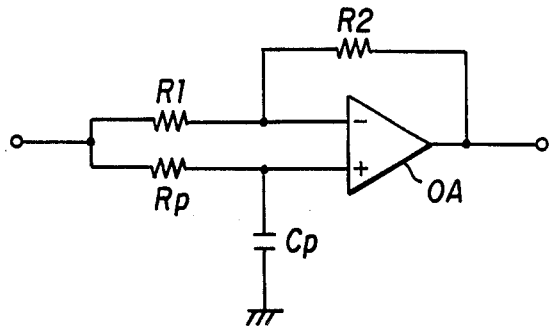
FIG. 3 PRIOR ART
FIG. 3 is a circuit diagram showing an example of a phase shifting element constructing the all-pass filter having the frequency versus phase characteristic as shown in FIG. 1.

In the aforementioned U.S. patent application Nos. 867,234 and 111,075, Tominari found that the dispersion as described is induced in the spectrum of a sound wave when the sound wave is reflected by walls or floor of architectures such as a concert hall. A similar finding is reported by J. Webers in "Tonstudiotechnik", p. 82, Munich 1979. In the acoustic space in such an architecture, the reverberation contains substantially no high frequency component higher than about 4 kHz. On the other hand, the sound components having a lower frequency have a large delay time which increases as the frequency decreases. For example, the sound component having a low frequency such as 50–100 Hz has a very large delay time such as 100 msec or more. The aforementioned U.S. patent application Nos. 867,234 and 111,075 disclose simulation of the discloses a simulation of the actual reverberation by electrically inducing the dispersion in the spectrum of the input audio signal by means of an all-pass filter in which the phase of the input audio signal is delayed according to a frequency versus phase delay characteristic such that the angle of phase delay increases steeply with frequency in a low frequency range and gradually approaches a very large constant at least larger than about 3000 degrees Such an all-pass filter may be advantageously constructed by cascading a well known phase shifting elements as shown in FIG. 3 in numerous stages. The phase shifting element in FIG. 3 has a transfer function as follows:

$$g(s) = \frac{1 - \tau \cdot s}{1 + \tau \cdot s} \quad (3)$$

Figure 4:
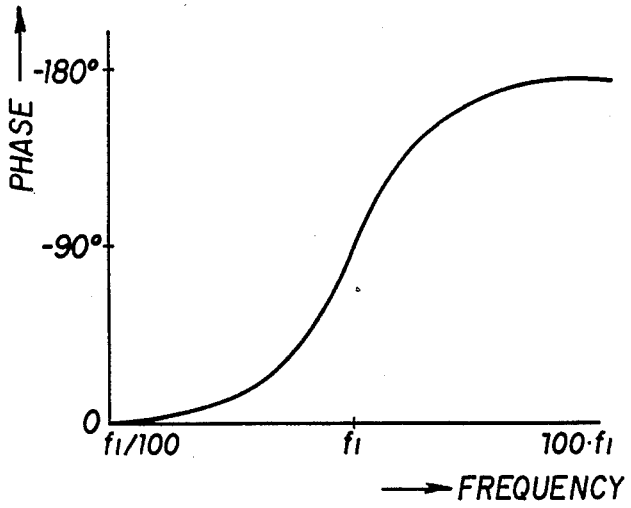
FIG. 4 PRIOR ART
FIG. 4 is a graph showing a frequency versus phase characteristic of the phase shifting element of FIG. 2.

The circuit in FIG. 3 is well known and therefore the detailed description of the circuit is not necessary. In summary, the circuit of FIG. 3 comprises an operational amplifier OA having inverting and noninverting input terminals, to which the input signal is applied via resistors R1 and Rp respectively. The output terminal is connected to the inverting input terminal via resistor R2. The noninverting input terminal is grounded through a capacitor Cp. The phase shifting element having the transfer function of Eq.(3) has a frequency versus phase characteristic as shown in FIG. 4. In Eq.(3), the parameter $\tau$ is defined by $\tau = R_p.C_p$, where $R_p$ and $C_p$ respectively represent the resistance and capacitance of a resistor $R_p$ and a capacitor $C_p$ in FIG. 3. From the frequency versus phase characteristic in FIG. 4, it can be seen that the phase shifting element of FIG. 3 produces a phase delay which is small in a low frequency range and increases gradually with frequency to approach 180 degrees phase angle at an infinite frequency. In the drawing, it is also seen that the frequency $f_1$ at which the phase delay reaches 90 degrees is defined by the equation $f_1 = \frac{1}{2}\pi\tau$.

By cascading the phase shifting element in FIG. 3 in n stages, a phase delay of $n \times 180$ degrees is obtained at a high frequency limit Thus, the parameter n in Eqs.(1) and (2) can be interpreted as the number of stages the phase shifting element of FIG. 3 is cascaded.

Figure 6:
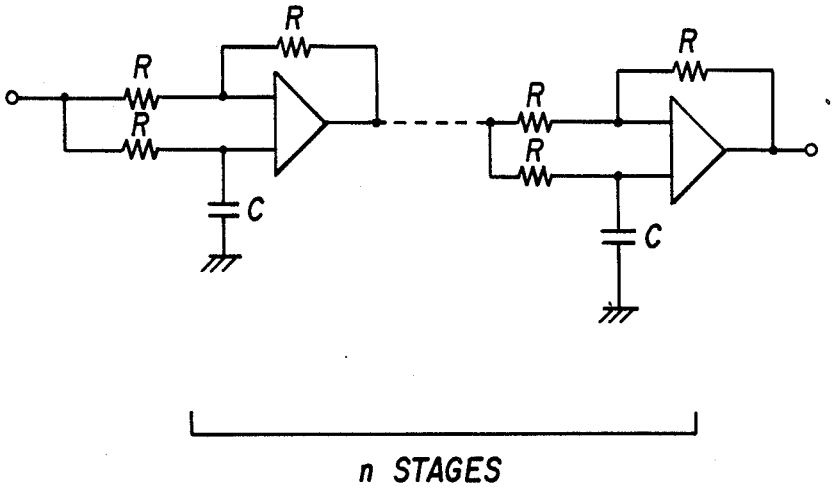
FIG. 6 PRIOR ART
FIG. 6 is a circuit diagram showing an example of the all-pass filter used in the reverb generator according to the present invention.

FIG. 6 shows an example of the all-pass filter for use in the reverb generator of the present invention, in which the phase shifting element of FIG. 3 is cascaded in numerous stages. By cascading the phase shifting element in such numerous stages, it becomes possible to obtain a frequency versus phase delay characteristic in which the delay of the phase increases steeply in a low frequency range and gradually approaches a very large constant ($n \times 180°$) in a higher frequency range as the frequency increases As described previously, the constant $n \times 180°$ has to be larger than about 3000 degrees. Thus, the value of n should be at least about 17, and is conveniently twenty. As described previously, the reverberation in the concert hall generally lacks the high frequency component higher than about 4 kHz. Further, it is known that the frequency components having a frequency higher than about 1 kHz do not introduce the feeling of echo to the listener. Thus, the frequency versus delay time characteristic in FIG. 2 which corresponds to the frequency versus phase delay characteristic of FIG. 1 produces very small or little delay time in the frequency range higher than about 1 kHz.

Next, a first embodiment of the reverb generator according to the present invention will be described with reference to FIGS. 7 through 9.

Figure 7:
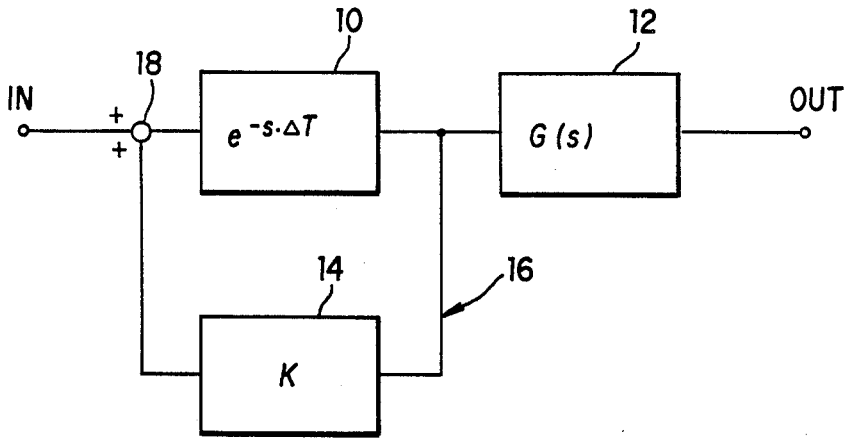
FIG. 7 is a circuit block diagram showing a first embodiment of the reverb generator of the present invention.

FIG. 7 shows the circuit block diagram of the first embodiment of the reverb generator of the present invention. In the drawing, the reference numeral 10 indicates a delay circuit having a transfer function of $e^{-s.\Delta T}$ for applying a delay time of $\Delta T$ to an input audio signal supplied thereto. The delay circuit 10 is connected in series to an all-pass filter 12 having a transfer function G(s) as defined by Eq.(1) or (2). As the all-pass filter having the transfer function defined by Eq.(2) is easily constructed as compared to the one having the transfer function of Eq(1) by simply cascading the identical phase shifting elements of FIG. 3 as shown in FIG. 6, the following description will be based on the all-pass filter having the transfer function of Eq.(2). However, it should be realized that the transfer function of the all-pass filter used in the reverb generator of the present invention is by no means limited to Eq.(2) but the transfer function of Eq.(1) having a more general form may be used as well.

An input audio signal applied to an input terminal ("IN" in FIG. 7) of the reverb generator is supplied to the delay circuit 10 whereby the audio signal is delayed by the delay time $\Delta T$ and an output signal thus obtained is supplied to the all-pass filter 12. The output signal is at the same time fed back to a summing junction 18 connected to an input port of the delay circuit 10 via a feed back path 16 including an attenuator 14, whereby a plurality of output signals each being attenuated and delayed by an additional delay time $\Delta T$ are produced sequentially and supplied to the all-pass filter 12. Advantageously, the all-pass filter 12 uses the phase shifting circuit shown in FIG. 6. An output audio signal is obtained from an output terminal ("OUT" in FIG. 7) connected to an output port of the all-pass filter 12. The delay circuit 10 and the feed back path 14 may be constructed from well known circuit elements and the descriptions thereof will be omitted. The portion of the circuit comprising elements 10, 14 and 16 is nothing but a conventional reverb generating circuit. Thus, the reverb generator of FIG. 7 has an advantage that it can be constructed very simply by connecting the all-pass filter 12 having the characteristics of FIGS. 1 and 2 (that is, a number of the known circuits of FIG. 3, cascaded as shown in FIG. 6) to an already existing conventional reverb generating circuit.

Figure 8:
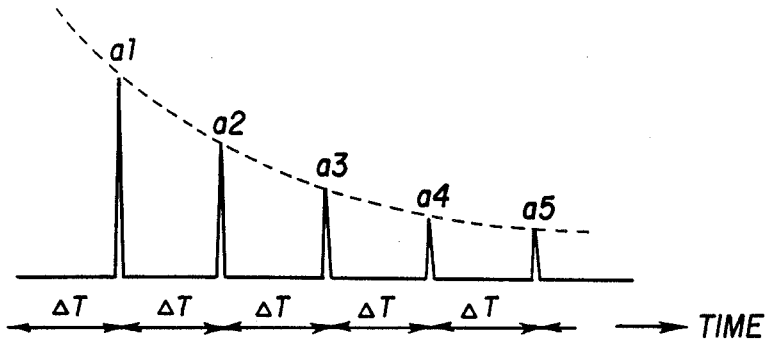
FIG. 8 is a diagram showing an impulse response of a part of the reverb generator shown in FIG. 6.

FIG. 8 shows an impulse response of the portion of the circuit comprising the reverb generator made up of elements 10, 14 and 16. Responsive to an input impulse, the delay circuit produces an output impulse $a_1$ at its output port with a delay time of $\Delta T$. The impulse $a_1$ is fed back to the input port of the delay circuit 10 via the feed back path 16 whereby a predetermined attenuation is applied to the impulse $a_1$ in accordance with a transfer function K. As a result, a second impulse $a_2$ having a same wave form but reduced in the height appears at the output port of the delay circuit 10 with a delay time $\Delta T$. This procedure is repeated and a series of exponentially attenuating impulses are repeatedly produced with an interval of $\Delta T$. The operation described so far is identical to the operation of the conventional reverb generator.

The series of impulses $a_1, a_2, a_3, a_4, a_5, \ldots$ are supplied to the all-pass filter 12. As already described, the all-pass filter is not a simple known phase shifter (as in FIG. 3) but is constructed by cascading the phase shifting element of FIG. 3 in numerous stages. Therefore, the all-pass filter 12 applies a dispersion to the spectrum of an input signal supplied thereto electrically to produce an output signal having a wave form similar to the sound waves formed by reflections at the walls or floor of the concert hall. For this purpose, the all-pass filter 12 must have a frequency versus phase delay characteristic such that the phase delay increases steeply with frequency in a low frequency range as the frequency increases and gradually approaches a very large constant larger than about 3000 degrees in a higher frequency range.

Thus, the all-pass filter 12 produces a series of signals having dispersion in the spectrum as shown in FIGS. 9(B)–(E). The amplitude of the signals in FIGS. 9(B)–(E) corresponds to the amplitude of the impulses $a_1$, $a_2$, $a_3$, $a_4$, and $a_5$. Thus, the reverb generator of the invention produces an output audio signal which is a superposition of the signals as shown in FIGS. 9(B)–(E). This output audio signal of the reverb generator has an extremely complex wave form and the illustration of this wave form is omitted.

Figures 9A, 9B, 9C, 9D, 9E:
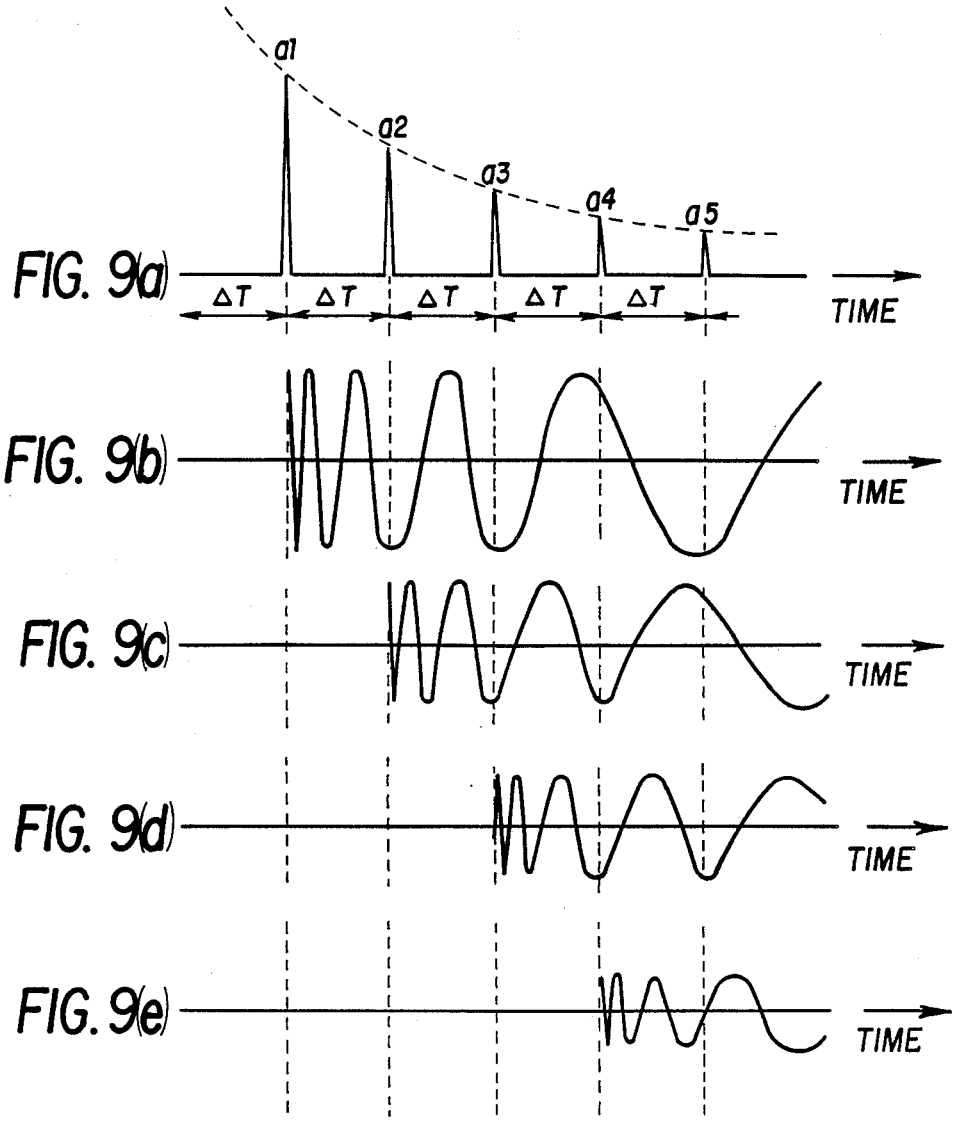
FIGS. 9 (A)–(E) are diagrams showing individual wave forms produced responsive to the impulses in FIG. 7 by the reverb generator in FIG. 6.

The impulses $a_1, a_2, a_3, a_4, a_5, \ldots$ shown in FIG. 9(A) correspond to the multiple reflections of a sound wave in the concert hall Thus, the signals in FIGS. 9 (B)–(E) simulate the reverberations produced by the dispersion of the reflected sound impulses at the walls or floor of the concert hall. In other words, the reverb generator of FIG. 7 can simulate the effect of multiple reflections in the concert hall. Further, the reverb generator can provide the feeling of the dimension of the concert hall by increasing or decreasing the delay time $\Delta T$. Of course, it is possible to generate an extraordinary or rather unusual effect intentionally by suppressing the dispersion such that the individual sounds corresponding to FIGS. 9(B)–(E) are resolved by the human ears.

FIG. 10 is a circuit block diagram showing a second embodiment of the reverb generator of the present invention. In the drawing, a delay circuit 20 having a transfer function of $e^{-s.\Delta T}$ is connected in series to an all-pass filter 22 having a transfer function defined by Eq.(1) or (2). In the following description, it is assumed that the all-pass filter 22 has the transfer function defined by Eq.(2) as it is easily constructed by cascading an identical phase shifting element as shown in FIG. 3 in numerous stages, as in FIG. 6. However, it should be realized that the transfer function is by no means limited to the one defined by Eq.(2) but the transfer function having more general form as defined by Eq.(1) can be used as well. Further, a feed back path 26 including an attenuator 24 is provided so that an output signal of the all-pass filter 22 is fed back via the feedback path 26 and the attenuator 24 to a summing junction 28 connected to an input port of the delay circuit 20.

An input audio signal applied to an input terminal ("IN" in FIG. 10) of the reverb generator is supplied to the input port of the delay circuit 20, wherein the input audio signal is delayed by a delay time $\Delta T$ specified by the transfer function $e^{-s.\Delta T}$ of the delay circuit. An output signal of the delay circuit thus obtained is then supplied to the all pass filter 22 where the signal is subjected to dispersion in accordance with the transfer function G(s) defined in Eq (2), in which the phase of the input signal is delayed in such a manner that the phase delay increases steeply with frequency in a low frequency range and gradually approaches a very large constant larger than about 3000 degrees in a higher frequency range. An output audio signal thus produced by the all-pass filter 22 is supplied to an output terminal (OUT in FIG. 10) of the reverb generator as an output audio signal of the reverb generator.

The output signal of the all-pass filter 22 is at the same time fed back from the all-pass filter 22 to the delay circuit 20 via the feed back path 26 and the attenuator 24. Thus, the input audio signal passes repeatedly through a signal path extending from an output port of the delay circuit 20 to the input port of the delay circuit 20, passing through the all-pass filter 22, the feed back path 26 and the attenuator 24.

The reverb generator of FIG. 10 has an overall transfer function H(s) as defined by the following equation:

$$H(s) = \frac{e^{-s\cdot\Delta T}\cdot G(s)}{1 - K\cdot e^{-s\cdot\Delta T}\cdot G(s)} \tag{4}$$

where G(s) is the transfer function defined by Eq.(2).

Expanding Eq.(4), H(s) can be rewritten as follows:

$$H(s)=e^{-s.\Delta T}.G(s)\{1+K.e^{-s.\Delta T}.G(s)+K^2.e^{-2s.\Delta T}.G(s)^2+K^3.e^{-3s.\Delta T}.G(s)^3+\ldots\} \tag{5}$$

FIGS. 11 (A)–(D) show an example of the impulse response of the reverb generator of FIG. 10. When an impulse shown in FIG. 11(A) is supplied to the delay circuit 20 from the input terminal IN, the impulse is delayed by a time $\Delta T$ and supplied to the all pass filter 22. The all-pass filter applies a dispersion to the incoming signal from the delay circuit 20 in accordance with the transfer function G(s) and produces an output signal wave form as shown in FIG. 11(B). The output signal from the all-pass filter 22 having the signal wave form in FIG. 11(B) is fed back to the input port of the delay circuit 20 via the feed back path 26 whereby the fed back signal is attenuated by the attenuator 24, and again supplied to the all-pass filter 22 with the additional delay time of ΔT. Thus, the all-pass filter 22 applies the dispersion to the signal already delayed by ΔT in accordance with the transfer function G(s). An output signal wave form thus produced is shown in FIG. 11(C) The output signal of the all-pass filter 22 having the wave form in FIG. 11(C) is again fed back to the input port of the delay circuit 20 via the feed back path, whereby the fed back signal is attenuated by the attenuator 24 similarly to the previous case, and then supplied to the all-pass filter 22 once more. Thus, the all-pass filter 22 produces an output signal wave form shown in FIG. 11(D). This procedure is repeated many times thereafter.

The output signal wave forms in FIGS. 11(B), (C) and (D) respectively correspond to the first term, second term and third term of Eq.(5), i.e. $e^{-s.\Delta T}.G(s)$, $K.e^{-2s.\Delta T}.G(s)^2$, and $K.^2e^{-3s.\Delta T}.G(s)^3$. These output signals are delayed by ΔT, 2ΔT, and 3ΔT, respectively, and furthermore, the effect of dispersion defined by the transfer function G(s) is exaggerated by each reflection giving the higher power to G(s) In other words, G(s)z or $G(s)^3$ means that the effect of G(s) is doubled, tripled and so on. Thus, the output signals correspond to the multiple reflections taking place in the concert hall. In the actual concert hall, the reverberation or the indirect sound is dispersed each time the sound is reflected from the wall or floor of the concert hall. Thus, the signal wave forms shown in FIGS. 11(B)-(D) more closely simulate the reverberation in the actual concert hall than the signal wave forms shown in FIGS. 9 (B)-(E). It should be noted that such a preferable feature is obtained as a result of the all-pass filter 22 being provided inside the feed back path 26.

Another advantage of providing the all-pass filter 22 in the feed back path 26 is that one can develop an extremely wide spread dispersion in the spectrum of an output signal by repeatedly feeding back the output signal having a dispersion already in its signal spectrum. Thus, one can utilize the feature of the feed back path to a full extent to realize a very colorful and long lasting reverberation.

Further, the reverb generator in FIG. 10 can produce a feeling of the dimension of the concert hall by adjusting the delay time ΔT. Of course, the reverb generator can intentionally produce an extraordinary reverberation effect by suppressing the dispersion.

Figure 12:
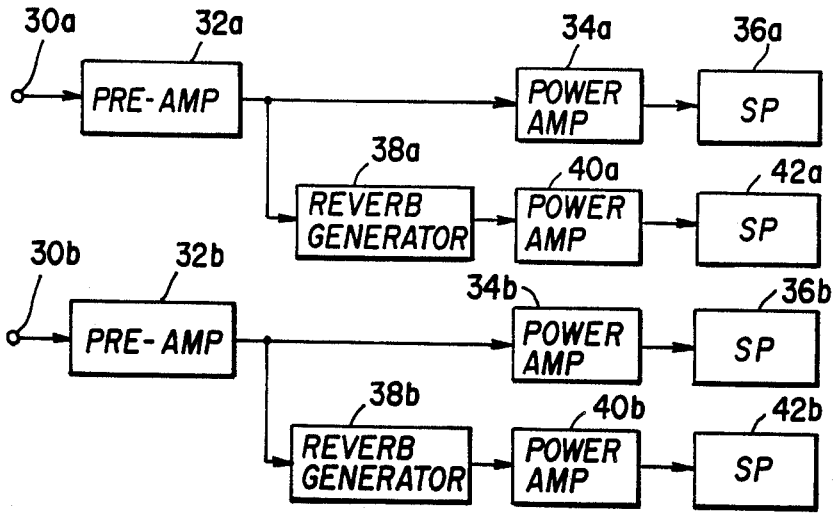
FIG. 12 is a circuit block diagram showing a multichannel reproducing system to which the reverb generator of the present invention can be applicable.

The reverb generator according to the present invention can be connected to various electric sound reproducing systems and electric musical instruments. FIG. 12 is a circuit block diagram of a multi-channel reproducing system which corresponds to one disclosed in the commonly owned U.S patent application Nos. 867,234 and 111,075, but incorporates the improvement made by the present invention. The reproducing system amplifies a right channel and left channel input audio signals applied to input terminals 30*a* and 30*b* by right and left pre-amplifiers 32*a*, 32*b* and right and left main-amplifiers 34*a*, 34*b* and radiates the direct sounds from right and left main speakers 36*a*, 36*b* as the direct sounds. In the prior applications, reference numerals 38*a* and 38*b* designate known all-pass filter having a transfer function defined by Eq.(1) or (2). According to the present invention, these are replaced by the reverb generators of FIGS. 7 or 10, which are used to apply a dispersion to incoming input signals being sub-channel audio signals from the pre-amplifiers 32*a* and 32*b*. These sub-channel audio signals are amplified by right and left sub-channel main amplifiers 40*a*, 40*b* and are radiated from right and left sub-speakers 42*a*, 42*b* as the indirect sound or reverberation. By using the reverb generators as shown in FIG. 7 or FIG. 10 according to the invention instead of the all-pass filters, it was found that an unexpected effect is obtained as will be described, in addition to the enhancement of the reverberation and improvement in the presence including the effect of multiple reflections.

Figure 13:
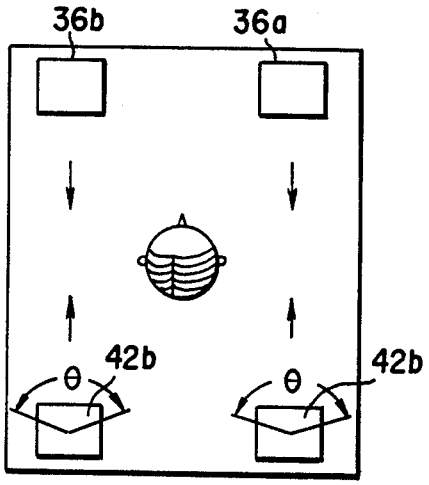
FIG. 13 is a plan view showing an example of arrangement of the speakers shown in FIG. 12 in a listening room.

FIG. 13 is a plan view showing a speaker arrangement in a listening room in which the multi-channel reproducing system in FIG. 12 is utilized. The right and left main speakers 36*a* and 36*b* are disposed in such a manner that they oppose the corresponding sub-speakers 42*a* and 42*b*, and the listener listen to the reproduced sound at a position generally at the center of the main and sub speakers. In the aforementioned U.S. patent application Nos. 867,234 and 111,075, the offset angle $\theta$ of the sub-speakers 42*a*, 42*b* relative to the opposing main speakers 36*a*, 36*b* is limited within about 30 degrees to obtain a satisfactory presence. It was found that, by using the reverb generator of the present invention as disclosed in FIG. 7 or FIG. 10 in place of the all-pass filters 38*a* and 38*b*, a satisfactory presence can be obtained even if the offset angle of the sub-speakers 42*a*, 42*b* to the opposing main speakers 36*a*, 36*b* is taken as large as 90 degrees or more. This significantly increases the degree of freedom of the speaker arrangement in the listening room.

Further, the present invention is not limited to those embodiments, but various variations and modifications may be made within the scope of the present invention.

What is claimed is:

1. A reverb generator for generating a plurality of reverberations responsive to an input audio signal, comprising:

time delay means having a single input port for receiving said input audio signal and a single output port for outputting said input audio signal as an output signal after a predetermined delay time;

means defining a feed back path for feeding back said output signal of said time delay means from said output port to said input port; and phase shifting means connected in series to said delay means for applying dispersion to the output audio signal, said phase shifting means comprising a cascaded connection of a plurality of phase shifting elements each producing increased phase delay with increased frequency over the entire frequency range of said input audio signal.

2. A reverb generator as claimed in claim 1 in which said phase shifting element comprises an operational amplifier having an inverting input terminal and a non-inverting input terminal to which the input audio signal is applied via respective resistors and an output terminal connected to said inverting input terminal via a feedback resistor, the non-inverting input terminal being grounded via a capacitor.

3. A reverb generator as claimed in claim 1 in which the output of said phase shifting means comprises means for delaying its output signal by a delay time varying with the frequency of the input signal, the delay time being more than about 100 msec at frequencies below about 50 Hz, and the delay time being reduced to virtually zero at frequencies above about 4 kHz.

4. A reverb generator as claimed in claim 1 in which said phase shifting means comprises a plurality of identical phase shifting elements arranged in a cascaded connection, each of the phase shifting elements having a transfer function substantially represented by $$g(s) = \frac{1 - \tau \cdot s}{1 + \tau \cdot s}$$

where $\tau$ is a time constant and s is the Laplacian operator.

5. A reverb generator as claimed in claim 1 in which said phase shifting means is connected in series to a circuit portion comprising the time delay means and the feed back path feeding back the output signal of the delays means from its output port to its input port.

6. A reverb generator as claimed in claim 1 in which said phase shifting means is included in the feed back path feeding back the output signal of the time delay means from its output port to its input port such that the phase shifting means applies the dispersion repeatedly, each time the input signal passes through said time delay means.

7. A reverb generator as claimed in claim 6 in which said phase shifting means is connected to the output port of said time delay means, said feed back path extends from the output port of the time delay means to its input port via said phase shifting means, and the output signal is obtained from an output port of said phase shifting means.

8. A reverb generator as claimed in claim 1 in which said feed back path includes attenuator means in the feed back path for attenuating the output signal of the time delay means fed back from the output port of said time delay means to the input port of said time delay means.

* * * * *